United States Patent [19]

Hartkorn

[11] Patent Number: 4,773,791

[45] Date of Patent: Sep. 27, 1988

[54] JOINT BRIDGING CONSTRUCTION FOR STRUCTURES

[76] Inventor: Alfred Hartkorn, Kolpingstrasse 25, D-8068 Pfaffenhofen, Fed. Rep. of Germany

[21] Appl. No.: 65,511

[22] Filed: Jun. 23, 1987

[30] Foreign Application Priority Data

Jul. 2, 1986 [DE] Fed. Rep. of Germany ..... 3622253

[51] Int. Cl.[4] ..... E01C 11/02

[52] U.S. Cl. ..... 404/68; 404/56; 52/396; 52/573

[58] Field of Search ..... 404/47, 54, 56, 62, 404/64, 65–69; 14/16.5; 52/396, 403, 573

[56] References Cited

U.S. PATENT DOCUMENTS

| | | | |
|---|---|---|---|
| 3,363,383 | 1/1968 | La Barge | 404/68 X |
| 3,417,528 | 12/1968 | Hallock | 404/47 |
| 3,720,474 | 3/1973 | Stog et al. | 404/47 |
| 3,887,292 | 6/1975 | Koster | 14/16.5 X |
| 4,637,085 | 1/1987 | Hartkorn | 404/66 X |

FOREIGN PATENT DOCUMENTS

| | | | |
|---|---|---|---|
| 2516427 | 10/1976 | Fed. Rep. of Germany . | |
| 2834361 | 1/1980 | Fed. Rep. of Germany . | |
| 3323778 | 1/1985 | Fed. Rep. of Germany . | |
| 3430404 | 2/1986 | Fed. Rep. of Germany . | |
| 8600102 | 1/1986 | PCT Int'l Appl. . | |
| 2093885 | 9/1982 | United Kingdom | 404/68 |

OTHER PUBLICATIONS

Migua, Hammerschmidt and Co., Expansion Joint Brochure, Feb. 1988.

*Primary Examiner*—Stephen J. Novosad
*Assistant Examiner*—John F. Letchford
*Attorney, Agent, or Firm*—Paul L. Sjoquist

[57] ABSTRACT

In a joint bridging construction for structures in which the sealing body of elastic material, which is flush with the top surface of the structure, by means of beads is inserted from above into upwardly open recesses of edge girders and against sliding-out is guarded by substantially circular retaining members one part of which are embedded in the retaining girders and the other part of which are embedded in the beads, there are provided, for structures constructed as buildings, edge girders each of which consists of at least one sheet metal strip extending in longitudinal direction of the joint, at least those two flanks of said strip facing the top surface of the building being formed by doubling the strip.

5 Claims, 2 Drawing Sheets

JOINT BRIDGING CONSTRUCTION FOR STRUCTURES

Figure 1:
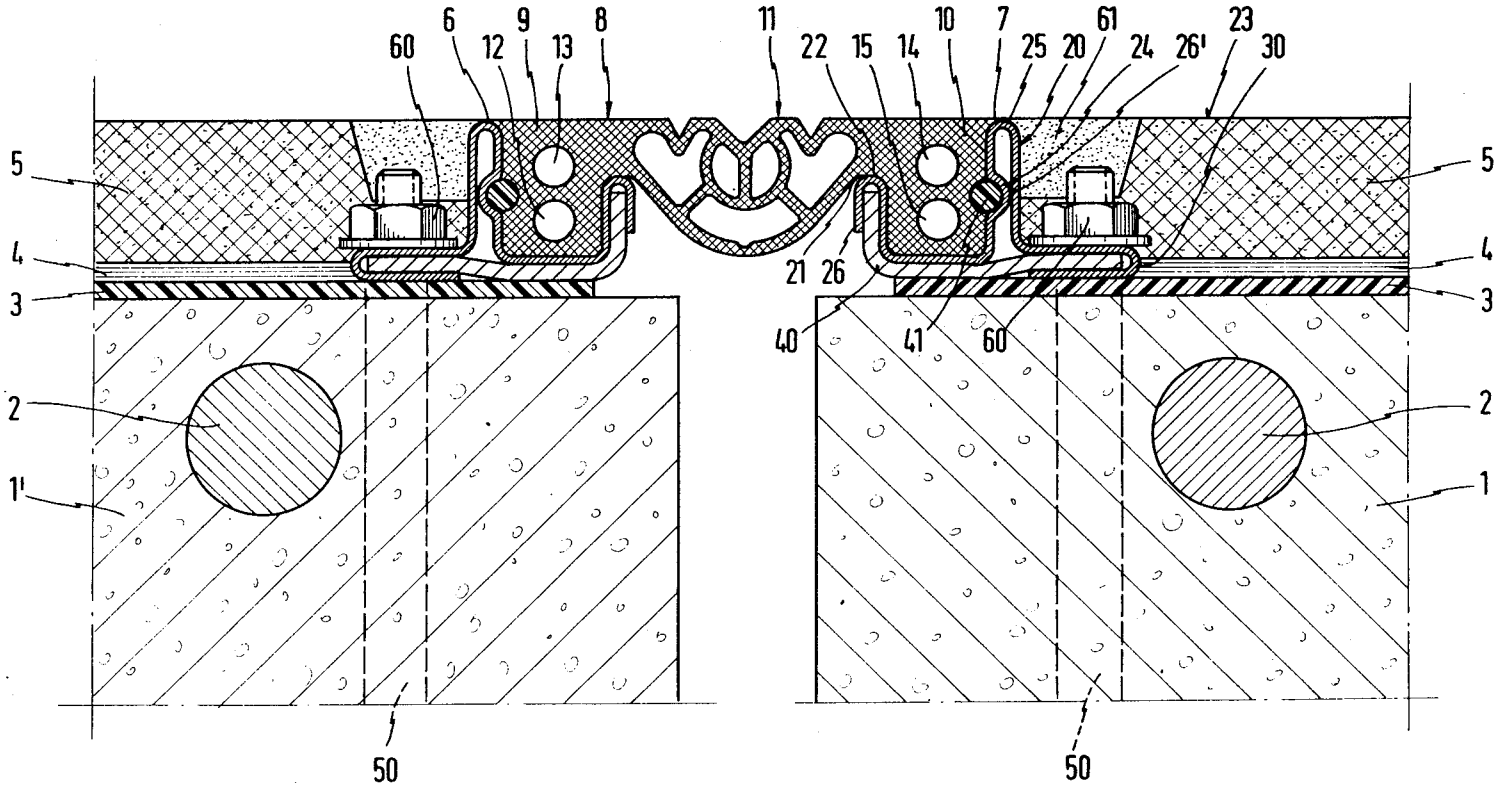

This invention relates to a joint bridging construction for structures where the sealing body, which is flush with the top surface of the structure and is made of elastic material, by means of beads is inserted from above into upwardly open recesses of edge girders and is guarded against sliding-out by substantially circular retaining members one part of which are embedded in the retaining girders and the other part of which are embedded in the beads.

The DE-AS No. 28 34 361 has made known such a joint bridging construction. This joint bridging construction, which can be used for bridges or the like, includes solid edge girders having an overall height of about 10 to 20 cm and being forked in the direction towards the road for receiving the beads. In order to make possible the insertion of the profiled joint, there are provided on the transition location between the lower face of the sealing body, which face is directed away from the road, and the bead edge extending vertically to the latter, recesses which are said to make easier insertion of the beads. Although this known joint bridging construction is suitable for bridges which have an overall height sufficient for allowing insertion of the edge girders, it is not suitable for being built-in in case of building joints or parking deck joints where is not provided the strongly reinforced substructure. In case of buildings, e.g. halls or also parking decks there is usually applied onto the strongly reinforced substructure an asphalt layer or a bituminous layer having a thickness of 2 to 4 cm.

This invention is based on the problem to provide a joint bridging construction where the overall height can be at a minimum, and which can be incorporated in the upper layer of ceiling covers, parking decks or the like.

This problem is solved according to the invention by providing for structures constructed as buildings edge girders which each consist of at least one sheet metal strip extending in longitudinal direction of the joints, at least those flanks of said strip facing the top surface of the building being formed by doubling the strip.

It is true, the DE-OS No. 25 16 427 has made known a joint bridging construction in which the beads of the sealing body—at a width-depth ratio of at least 1:1—in the region facing away from the road each have laterally extending barb-shaped lips to prevent the beads from automatically sliding-out of the U-shaped edge girder. The flanks of the U-shaped edge girder consisting of a plate-shaped material each are facing the top surface of the road and have substantially sharp edges. This known joint bridging construction is not suitable for being inserted in building alone for the reason that the substructure, i.e. particularly the edge girders, make(s) necessary a relatively large overall height, e.g. a dimension of 10 to 15 cm, and the sharp edges of the edge girder—as far as the latter naturally grip the bead only from beneath—can damage the sealing profile when the latter is being subjected to a travelling load.

According to a preferred embodiment of the invention, there is provided at least one further sheet metal strip which has an approximately L-shaped cross-section, each of its free edges having the first sheet metal strip bent around it.

The flanks of the edge girder facing away from the joint can have, for embedding the retaining member, indentations whose rear sides rest against a rectilinear section of the edge girder.

The beads of the sealing member can have a depth between 2 and 3 cm and be formed like a block having an approximately rectangular cross-section; it is also possible that a rounded edge, which is formed by doubling of the sheet metal strip and faces the top side of the building, is in the form of a hinge for the sealing profile. If the sealing profile has an accordingly adapted groove at the respective location, the articulation effect is increasingly improved.

According to a modified embodiment of the invention, a rounded edge of the edge girder, which edge is formed by doubling the metal sheet strip, extends approximately flush with the the top side of the building.

The sealing profile can be embedded in the uppermost layer, e.g. of asphalt, of the top side of the building. It is also possible that a joint sealing compound facing away from the joint and supporting the rear section of the edge girder extends only as far as up to the height of the retaining member.

According to a further preferred embodiment of the invention, the sheet metal strip(s) has (have) a thickness of about 1.5 to 3 mm.

Also, those sections of the edge girder which extend parallel to each other and constitute a doubling can be spaced from each other a distance which corresponds to the thickness of the sheet metal strip(s).

The drawing presents exemplifying embodiments of the invention in cross-section; they are described hereinafter in more detail. It is shown in FIG. 1 a longitudinal section through an embodiment of the invention, and FIG. 2 a longitudinal section through another embodiment of invention.

The plotting scale of the drawing is 1:1, thus the representation showing substantially the natural size.

According to the embodiment of the invention as shown in FIG. 1 of the invention, there is to be provided, in a parking deck bridging construction, a watertight insulating connection only in the uppermost layer of the building. The shown joint width of the concrete body 1 having a thickness of e.g. 20 cm and provided with the distributor iron 2 in the shown position is about 20 mm.

The joint bridging construction as described hereinafter in more detail can be means of usual folding movements of the central section within 35 mm follow the relative movements of the two concrete bodies 1 and 1'. There is applied onto the concrete body 1 and 1' an insulation having a thickness of 3 mm and made of roofing paper. There is applied on the approximately equally thick sliding layer 4 applied onto said roofing paper, the uppermost layer 5 made of asphalt or bitumen and having a thickness of about 24 mm. In the region of the joint, there are provided two edge girders 6 and 7 supporting a sealing member 8.

The sealing member consists of two beads 9 and 10 between which is provided a collapsible section 11. The approximately rectangular beads have recesses 12, 13, 14 and 15 which extend in longitudinal direction of the joint and are to make possible deforming of the beads so that same can be inserted into the edge girders 6 and 7 while being squeezed.

The edge girders 6 and 7, which are mirror-inverted to each other, consist of strips of steel having a thickness of about 2 cm and extending in the longitudinal direction of the joint. One strip 20 extends from a hinge point 21 of the sealing member where is provided a bend 22 in the direction towards the concrete body 1, then parallel to the latter and then again in the direction towards the top side 23 of the building. The sheet metal strip extends further along a semi-circular indentation 24 to a bend 25, thereby causing doubling of said strip, similar to the doubling at its free end 26.

The section 26' extending vertically to the top side of the building supports the rear side of the indentation 24, between the indentation and said section being only a frictional contact but not any other connection.

Then the strip of sheet steel extends parallel to the top edge of the concrete body 1 to a further bend 30 so that in this region, too, i.e. parallel to the surface of the concrete body 1, the respective section of the strip is doubled.

As can be seen from FIG. 1, there is provided a second strip 40 which is approximately L-shaped and on the one hand embraces the above mentioned sheet metal strip at its end 26 and on the other hand also the section of the sheet metal strip including the bend 30 directly above the insulation 3. The steel sheet metal strips extend along the entire length of the joint.

In the region of the indentation 24, there is inserted a retaining member 41 which, having a circular cross-section, is a round cord of e.g. synthetic material and is adapted to fit into the indentation 24 and on the other hand into a semi-circular recess in the bead.

In case of the shown embodiment, the edge girder consisting of strips 20, 40 is secured to the concentrate body 1 by means of screw bolts 50. The screw bolts 1 anchored in the concrete body 1 prevent the concrete body 1 and the joint bridging construction from moving towards each other.

The fact that there is not a direct connection between the identation 24 and the adjacent section of the strip 20 results in that there is possible a minor relative movement between the location of indentation and the associated section of the strip 20, whereby in this way insertion of the beads 9 and 10 is facilitated.

It is not absolutely necessary that—as shown—the bend 25 has to be located so as to be flush with the top surface 23 of the building, but it can also be placed at a deeper location so that the free edge of the bead 10 laps over said bend 25.

In case of the shown embodiment, there is provided in the region of the nut 60 of the screw bolt 50 a joint sealing compound 61 whose underside, however, extends only as far to the center of the height of the round cord 41, as shown.

The sealing body is in the commonly used way made of rubber or a rubber-like synthetic material, e.g. Neoprene. The retaining member, which is in the form of a round cord, is also made of a similar material; it can also be made of steel.

The sheet metal strips of steel extend over the whole length of the joint.

Figure 2:
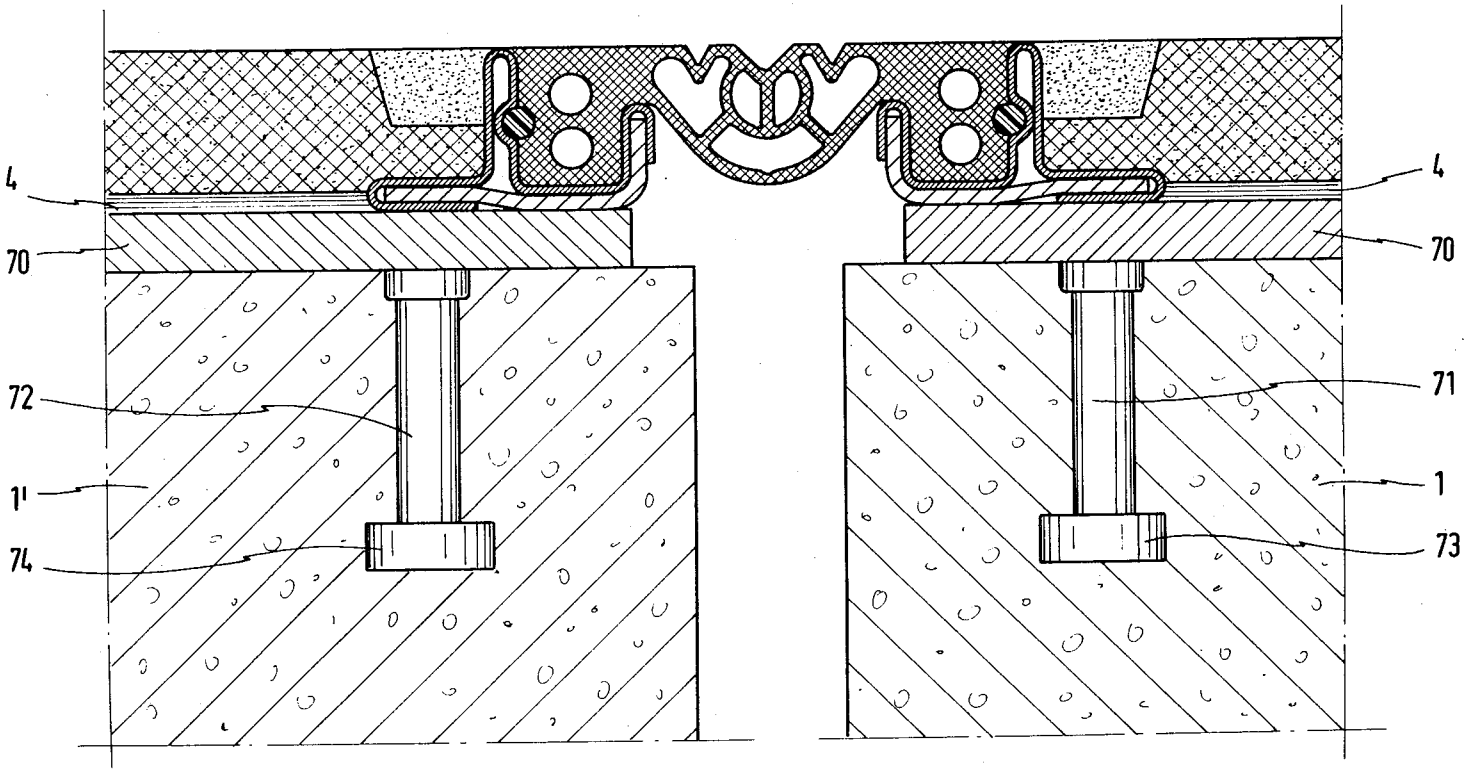

In case of the modified embodiment of the invention as shown in FIG. 2, it is true, the sealing body and the superstructure are designed like those of the embodiment as shown in FIG. 1, but in this embodiment, there is provided beneath the sliding layer 4 a plate 70 made of steel and in the present case having a thickness of 10 mm. The concrete bodies 1 and 1' of this embodiment have only a depth of 10 cm, the joint in the position as shown has a width of 25 mm.

Pins 71,72 having a length of about 5 cm and at their ends being provided with heads 73,74, respectively, are embedded in the concrete bodies 1 and 1'. Said pins 71,72 are welded together with the plate 70. It is possible to embed in the concrete body 1,1' instead of the pins 71,72 also metal sleeves having internal screw threads in which are inserted screw bolts for holding the edge girders.

The edge girders are in all the cases constructed such that the concrete bodies 1 and 1' need not be worked; i.e. the lower surface of each of them is placed directly beneath the beads so that it is easily possible to build-in the joint bridging device when the concrete body has been finished.

The shear connectors in the form of pins can also obliquely project into the concrete body and be directly welded together with that section of the sheet metal strip which extends parallel to the concrete body (see FIG. 1).

I claim:

1. A joint bridging construction for structures, comprising a sealing body which is flush with the top surface of the structures and is made of elastic material, said sealing body is inserted by means of beads from above into upwardly open recesses of edge girders and is guarded against sliding out by substantially circular retaining members, one part of which is embedded in the edge girders and the other part of which is embedded in the beads, characterized in that each of said edge girders, which consists of at least one sheet metal strip extending in the longitudinal direction of the joint, has at least a top flank facing top surface, said top flank being formed by doubling the strip, said strip further having two respective free ends formed by doubling the strip; and at least one further sheet metal strip whose cross-section is approximately L-shaped, said further strip engaged into the respective free ends formed by doubling.

2. A joint bridging construction according to claim 1, characterized in that each said top flank of the edge girders has an indentation extending in the longitudinal direction of the joint whose rear side rests against a rectilinear section of the edge girders, said indentation further embeds one of said retaining members in said top flank of said edge girders.

3. A joint bridging construction according to claim 1, characterized in that the beads of the sealing body have a depth of between 2 and 3 cm and are formed like a block having an approximately rectangular cross-section.

4. A joint bridging construction according to claim 1, characterized in that a rounded edge of one of said free ends produced by doubling of the sheet metal strip also faces the top surface and is constructed as a hinge for the sealing body.

5. A joint bridging construction according to claim 1, characterized in that a rounded edge of the top flank of the sheet metal strip formed by doubling of the strip extends approximately flush with the top surface.

* * * * *